US011746586B2

(12) United States Patent
Yamagami et al.

(10) Patent No.: US 11,746,586 B2
(45) Date of Patent: Sep. 5, 2023

(54) CONNECTING DEVICE FOR CONSTRUCTION MATERIALS, CONNECTING STRUCTURE THEREFOR, AND CONNECTING METHOD THEREFOR

(71) Applicant: BUNKA SHUTTER CO., LTD., Tokyo (JP)

(72) Inventors: Shigeo Yamagami, Tokyo (JP); Masanori Kobayashi, Tokyo (JP); Takayuki Maeda, Tokyo (JP)

(73) Assignee: BUNKA SHUTTER CO., LTD., Tokyo (JP)

( * ) Notice: Subject to any disclaimer, the term of this patent is extended or adjusted under 35 U.S.C. 154(b) by 84 days.

(21) Appl. No.: 17/601,090

(22) PCT Filed: Apr. 5, 2019

(86) PCT No.: PCT/JP2019/015136
§ 371 (c)(1),
(2) Date: Oct. 4, 2021

(87) PCT Pub. No.: WO2020/202550
PCT Pub. Date: Oct. 8, 2020

(65) Prior Publication Data

US 2022/0205310 A1 Jun. 30, 2022

(51) Int. Cl.
*E06B 1/60* (2006.01)
*E06B 1/12* (2006.01)

(52) U.S. Cl.
CPC ..... *E06B 1/603* (2013.01); *E06B 1/12* (2013.01)

(58) Field of Classification Search
CPC ... E06B 1/603; E06B 1/52; E06B 1/56; E06B 1/6038; E06B 1/6046; E06B 1/6053;
(Continued)

(56) References Cited

U.S. PATENT DOCUMENTS 1,458,025 A * 6/1923 Biele ..... E06B 1/18 52/217
1,718,813 A * 6/1929 Finley ..... E06B 1/08 49/505

(Continued)

FOREIGN PATENT DOCUMENTS

CN 2744811 Y 12/2005
CN 101498399 A 8/2009

(Continued)

OTHER PUBLICATIONS

Microfilm of the specification and drawings annexed to the request of Japanese Utility Model Application No. 119145/1971 (Laid-open No. 74432/1973) (Kimura, Yutaka) Sep. 17, 1973, entire text, in particular, specification, p. 1, lines 3-5, p. 2, lines 1-23, all drawings.

(Continued)

*Primary Examiner* — James M Ference
(74) *Attorney, Agent, or Firm* — Robert P. Michal, Esq.; Carter, DeLuca & Farrell LLP

(57) ABSTRACT

A connecting device configured to connect two construction materials arranged at a distance therebetween, that is, a door frame, a base member, and a reinforcing member of a wall includes a connecting member including a locking portion capable of being locked with a locking target member arranged at one construction material along a thickness direction perpendicular to a direction of the distance and a coupling portion configured to be moved in the thickness direction and coupled to the other construction material by a drill screw as a coupling fitting are arranged at an end on a side of the one construction material and an end on a side of the other construction material. When the coupling portion is not coupled to the other construction material, the locking portion is movable in the thickness direction with respect to the locking target member.

13 Claims, 10 Drawing Sheets

(58) Field of Classification Search
CPC .... E06B 1/6061; E06B 1/6069; E06B 1/6076; E06B 1/62; E06B 1/70; E06B 1/12
See application file for complete search history.

(56) References Cited

U.S. PATENT DOCUMENTS

| | | | | | |
|---|---|---|---|---|---|
| 2,284,074 | A * | 5/1942 | Stahl | E06B 1/18 | 52/211 |
| 2,859,491 | A * | 11/1958 | Morris, Jr. | E06B 1/08 | 49/467 |
| 3,250,049 | A * | 5/1966 | Sklar | E06B 1/6061 | 52/211 |
| 3,518,794 | A * | 7/1970 | Horner | E06B 1/045 | 49/505 |
| 3,571,996 | A * | 3/1971 | Braswell | E06B 3/9885 | 49/505 |
| 3,585,770 | A * | 6/1971 | Maizler | E06B 1/6061 | 403/231 |
| 3,685,226 | A * | 8/1972 | Richter | E06B 1/603 | 49/505 |
| 3,906,671 | A * | 9/1975 | Maldonado | E06B 1/20 | 49/505 |
| 4,128,977 | A * | 12/1978 | Schubeis | E06B 1/20 | 52/212 |
| 4,453,346 | A * | 6/1984 | Powell | E06B 1/6076 | 49/404 |
| 4,873,804 | A * | 10/1989 | Kukke | E06B 1/6076 | 411/116 |
| 5,655,343 | A * | 8/1997 | Seals | E06B 1/6069 | 52/745.15 |
| 6,216,402 | B1 * | 4/2001 | Van de Laar | E06B 1/6069 | 52/204.56 |
| 7,987,637 | B2 * | 8/2011 | Smith | E06B 1/6076 | 49/504 |
| 8,806,812 | B2 * | 8/2014 | Kolovich | E06B 1/6046 | 52/126.4 |
| 2008/0075556 | A1 * | 3/2008 | Smith | F16B 5/0233 | 411/379 |
| 2012/0211636 | A1 * | 8/2012 | Sirek | E06B 3/96 | 248/544 |
| 2014/0260008 | A1 * | 9/2014 | Eis | E04F 21/0015 | 52/749.1 |
| 2018/0187475 | A1 * | 7/2018 | Mitchell | E04F 21/0015 | |
| 2022/0205310 | A1 * | 6/2022 | Yamagami | E06B 1/603 | |

FOREIGN PATENT DOCUMENTS

| | | | |
|---|---|---|---|
| CN | 207749946 | U | 8/2018 |
| DE | 8400332 | U1 | 3/1984 |
| EP | 0969177 | A1 | 1/2000 |
| JP | S4854432 | U | 7/1973 |
| JP | S4874432 | U | 9/1973 |
| JP | S4874432 | U | 9/1973 |
| JP | S5079224 | U | 7/1975 |
| JP | S5214368 | Y | 3/1977 |
| JP | S547147 | B2 | 4/1979 |
| JP | S54182561 | U | 12/1979 |
| JP | S54182562 | U | 12/1979 |
| JP | S553904 | A | 1/1980 |
| JP | S56100671 | U | 8/1981 |
| JP | S56100672 | U | 8/1981 |
| JP | S56100684 | U | 8/1981 |
| JP | S56107069 | U | 8/1981 |
| JP | S5980082 | U | 5/1984 |
| JP | S5982184 | U | 6/1984 |
| JP | S59233085 | A | 12/1984 |
| JP | H07229354 | A | 8/1995 |
| JP | 913800 | A | 1/1997 |
| JP | 09184397 | A | 7/1997 |
| JP | 2006307633 | A | 11/2006 |
| JP | 2012154084 | A | 8/2012 |
| JP | 2015071863 | A | 4/2015 |
| JP | 2015224482 | A | 12/2015 |
| JP | 2017115462 | A | 6/2017 |
| JP | 2017115463 | A | 6/2017 |
| JP | 2019011667 | A | 1/2019 |
| JP | 2020007748 | A | 1/2020 |
| KR | 10-2009-0008920 | A | 1/2009 |
| TW | M488540 | U | 10/2014 |

OTHER PUBLICATIONS

Microfilm of the specification and drawings annexed to the request of Japanese Utility Model Application No. 177815/1982 (Laid-open No. 82184/1984) (The Yamazaki Corporation) Jun. 2, 1984, entire text, all drawings.
Microfilm of the specification and drawings annexed to the request of Japanese Utility Model Application No. 134029/1973 (Laid-open No. 79224/1975) (Sankyo Aluminum Kogyo KK) Jul. 9, 1975, entire text, fig. 1-4, 6-10.
Notice of Reasons for Refusal issued by the Japanese Patent Office in relation to Japanese Application No. 2020-021530 dated Apr. 27, 2021 (3 pages) along with English language translation (3 pages).
U.S. Appl. No. 17/257,614, filed Jan. 4, 2021.
U.S. Appl. No. 17/257,628, filed Jan. 4, 2021.
Extended European Search Report issued by the European Patent Office in relation to European Application No. 19 83 0020 dated Nov. 23, 2021 (10 pages).
Notice of Reasons for Refusal issued by the Japanese Patent Office in relation to Japanese Application No. 2020-122849 dated Mar. 8, 2022 (4 pages) along with English language translation (4 pages).
Notice of Reasons for Refusal issued by the Japanese Patent Office in relation to Japanese Application No. 2020-122848 dated Mar. 8, 2022 (6 pages) along with English language translation (5 pages).
Notice of Reasons for Refusal issued by the Japanese Patent Office in relation to Japanese Application No. 2020-122847 dated Mar. 8, 2022 (7 pages) along with English language translation (7 pages).
Microfilm of Japanese Utility Model Application No. S54-182564.
Microfilm of Japanese Utility Model Application No. S54-182561.
Microfilm of Japanese Utility Model Application No. S57-176414.
Extended European Search Report issued by the European Patent Office in relation to European Application No. 19830876.9 dated Nov. 23, 2021 (8 pages).
Microfilm of the specification and drawings annexed to the request of Japanese Utility Model Application No. 11745/1986 (Laid-open No. 124184/1987) (Shin Nikkei Company, Ltd.) Aug. 6, 1987, entire text, all drawings (Family: none) English translation (26 pages).
Microfilm of the specification and drawings annexed to the request of Japanese Utility Model Application No. 86108/1978 (Laid-open No. 4215/1980) (Mitsui Keikinzoku Kakou KK) Jan. 11, 1980, entire text, all drawings (Family: none) English translation (19 pages).
International Search Report issued by the Japanese Patent Office acting as the International Searching Authority in relation to International Application No. PCT/JP2019/015136 dated Jul. 16, 2019 (3 pages) along with English language translation (2 pages).
Search Report of TW Patent Applcation No. 109127359 dated Jul. 15, 2022 (1 page) along with English language translation (1 page).
Office Action issued by the The Intellectual Property Office Ministry of Economic Affairs, in relation to Taiwanese Application No. 109127359 dated Jul. 19, 2022 (6 pages) along with English language translation (4 pages).
Notice of Reasons for Refusal issued by the Japanese Patent Office in relation to Japanese Application No. 2018-128166 dated Feb. 15, 2022 (4 pages) along with English language translation (4 pages).
Microfilm of Japanese Utility Model Application No. S46-119145.
Microfilm of Japanese Utility Model Application No. S46-97756.
Notice of Reasons for Refusal issued by the Japanese Patent Office in relation to Japanese Application No. 2020-122946 dated Mar. 15, 2022 (5 pages) along with English language translation (5 pages).
Notice of Reasons for Refusal issued by the Japanese Patent Office in relation to Japanese Application No. 2020-022040 dated Mar. 15, 2022 (4 pages) along with English language translation (4 pages).

(56) References Cited

OTHER PUBLICATIONS

Office Action issued by the China National Intellectual Property Administration, corresponding to Chinese Application No. 201980095214.2 dated Oct. 8, 2022 (8 pages) along with English translation (5 pages).
Office Action issued by the China National Intellecutal Property Administration in relation to Chinese Application No. 201980045119.1 dated Jun. 1, 2022 (7 pages) along with English language translation (7 pages).

* cited by examiner

CONNECTING DEVICE FOR CONSTRUCTION MATERIALS, CONNECTING STRUCTURE THEREFOR, AND CONNECTING METHOD THEREFOR

CROSS-REFERENCE TO RELATED APPLICATIONS

This application is a national phase entry under 35 U.S.C. 371 of PCT International Application No. PCT/JP2019/015136 filed Apr. 5, 2019, the disclosure of this application is expressly incorporated herein by reference in its entirety.

TECHNICAL FIELD

The present invention relates to a connecting device for construction materials, a connecting structure therefor, and a connecting method therefor, and more particularly to a connecting device for construction materials, a connecting structure therefor, and a connecting method therefor that can be used to connect two construction materials arranged at a distance therebetween, for example, an apparatus-side construction material such as a door frame and a skeleton-side construction material such as a building.

BACKGROUND ART

Patent literature 1 below shows that a door frame serving as a doorway is arranged as an opening frame inside of an opening portion formed in a wall serving as a skeleton such as a building. In this example, the interior is opened/closed by a hinged door.

RELATED ART LITERATURE

Patent Literature 1: Japanese Patent Laid-Open No. 2015-71863

DISCLOSURE OF INVENTION

Problem to be Solved by the Invention

A work for arranging an opening frame such as a door frame inside an opening portion formed in a wall includes a connecting work for connecting the opening frame and a skeleton-side construction material arranged on the wall side. This connecting work is a work for setting the opening frame in an immobile state with respect to the skeleton-side construction material. By this connecting work, with respect to the skeleton-side construction material, the opening frame must be set in the immobile state in a thickness direction perpendicular to a direction of the distance between the skeleton-side construction material and the opening frame.

The present invention has as its object to provide a connecting device for construction materials, a connecting structure therefor, and a connecting method therefor that can connect two construction materials arranged at a distance therebetween in the immobile state in the thickness direction perpendicular to the direction of the interval between the two construction materials, and at the same time can easily perform this connecting work.

Means of Solution to the Problem

A connecting device for construction materials according to the present invention is a connecting device for construction materials configured to connect two construction materials arranged at a distance therebetween, the connecting device comprising a connecting member including a locking portion capable of being locked with a locking target member arranged at one construction material of the two construction materials along a thickness direction perpendicular to a direction of the distance and a coupling portion configured to be moved in the thickness direction and coupled to the other construction material of the two construction materials by a coupling fitting, the locking portion and the coupling portion arranged at an end on a side of the one construction material and an end on a side of the other construction material, respectively, wherein in a state in which the coupling portion is not coupled to the other construction material, the locking portion is movable in the thickness direction with respect to the locking target member, and as the coupling portion is moved in the thickness direction and coupled to the other construction material by the coupling fitting, the locking portion is moved in a direction having a component of the thickness direction with respect the locking target member and is locked with the locking target member, thereby the connecting member connects the two construction materials.

According to this connecting device, when the coupling portion is coupled to the other construction material of the two construction materials by the coupling fitting, the locking portion is moved in the direction having the component of the thickness direction with respect to the locking target member arranged on one construction material. This locking portion is locked with the locking target member, thereby connecting the two construction materials by the connecting device. For this reason, the two construction materials arranged at a distance therebetween can be connected in the immobile state in the thickness direction perpendicular to the direction of the interval. In addition, this connecting work can be naturally performed by coupling the coupling portion arranged at the connecting member of the connecting device to the other construction material by the coupling fitting. Furthermore, the connecting work can be performed without using fire for welding. Therefore, the connecting work can be easily performed.

In an embodiment of the connecting device according to the present invention, when the coupling portion is moved in the thickness direction by the coupling fitting, the locking portion may be arranged to be moved diagonally with respect to the locking target member and locked with the locking target member at an angle. Alternatively, when the coupling portion is moved in the thickness direction by the coupling fitting, the locking portion may be arranged to be obliquely moved with respect to the locking target member and locked with the locking target member with an angle.

In the latter case, when the locking portion is locked with the locking target member, the locking portion forms an angle with respect to the locking target member. The locking portion can be further reliably locked with the locking target member.

A direction in which the locking portion is moved with respect to the locking target member and a direction in which the coupling portion is moved with respect to the other construction material by the coupling fitting may be the same direction as the thickness direction or different directions in the thickness direction.

In addition, in one embodiment of the connecting device according to the present invention, the connecting member in the thickness direction may include one connecting member or a plurality of connecting members.

Furthermore, if the number of the connecting members in the thickness direction is two, a bridge portion bridged between the two connecting members may further be included.

As described above, if the number of the connecting members in the thickness direction of the connecting member is two, and the bridge portion bridged between the two connecting members is further included, the bridge portion may be set in a form of a plate, and a notched portion may be formed in the bridge portion in the direction of the interval of the two construction materials.

When the coupling portions of the two connecting members are moved in opposite directions of the thickness direction by the coupling fitting and are coupled to the other construction material, the locking portions of the two connecting members are moved in the opposite directions of the thickness direction with respect the locking target member by the action of the notched portion. The locking portions are moved by the coupling fitting in the connecting members in the direction opposite to the direction for moving the coupling portions with respect to the other construction material. As a result, the locking portions are locked with the locking target members, so that the two construction materials can be connected by the connecting device.

Note that one notched portion notched from one of the two ends in the bridge portion on the two construction material sides may be used. Alternatively, the number of notched portions may be two. These two notched portions are notched from the two ends of the bridge portion on the two construction material sides. A connecting portion for connecting the two connecting members in the bridge portion may be formed between these two notched portions.

In the latter case, when the coupling portions of the connecting members are moved in opposite directions of the thickness direction by the coupling fitting and are coupled to the other construction material, the locking portions can further reliably perform movement in the opposite directions of the thickness direction with respect the locking target members by the action of the two notched portions, that is, the movement in the direction opposite to the direction for moving the coupling portions to the other construction material by the coupling fitting. For this reason, these locking portions can further reliably be locked with the locking target portions. This makes it possible to connect the two construction materials by the connecting device.

In the connecting device described above according to the present invention, the locking target member arranged on one construction material may be, for example, an elongated member having a length in the thickness direction. As described above, if the locking target member is an elongated member, the locking portion arranged at the end portion of the connecting device on the side of one construction material may be set as an insertion portion for receiving the elongated member.

In addition, if the locking target member arranged on one construction material is set as the elongated member having the length in the thickness direction and the locking portion arranged at the end portion of the connecting device on the side of one construction material is set as the insertion portion for receiving the elongated member, the uneven portions for locking the inner circumferential corner portion of the insertion portion are preferably formed on the surface of the elongated member.

According to this, since the inner circumferential corner portion of the insertion portion serving as the locking portion can further reliably be locked with the elongated member by the uneven portions formed on the surface of the elongated member, the two construction materials arranged at a distance therebetween can further reliably be connected in the immobile state in the thickness direction perpendicular to the direction of the interval by the connecting device of the present invention.

When the locking target member is set as the elongated member and the uneven portions are formed on the surface of this elongated member, the locking target member may be implemented by a bolt shaft having the surface threaded with a male screw or a pin having a knurled surface. In addition, when the locking portion formed in the connecting member is set as the insertion portion for receiving the elongated member, this can be implemented by setting the locking portion as a hole, a notched portion, or the like.

In addition, the locking target member maybe in a form of a plate. At this time, the locking portion may have, for example, a groove shape if the locking portion can be moved and locked in the thickness direction with respect the plate-like locking target member. In addition, by reducing the hardness of the locking target member as compared with the connecting device, the locking portion of the connecting device can further reliably be locked with the locking target member.

A connecting structure for construction materials according to the present invention is a connecting structure for construction materials configured to connect two construction materials arranged at a distance therebetween by a connecting device arranged between the construction materials, wherein the connecting device comprises a connecting member including a locking portion capable of being locked with a locking target member arranged at one construction material of the two construction materials along a thickness direction perpendicular to a direction of the distance and a coupling portion configured to be moved in the thickness direction and coupled to the other construction material of the two construction materials by a coupling fitting, the locking portion and the coupling portion arranged at an end on a side of the one construction material and an end on a side of the other construction material, respectively, wherein in a state in which the coupling portion is not coupled to the other construction material, the locking portion is movable in the thickness direction with respect to the locking target member, and as the coupling portion is moved in the thickness direction and coupled to the other construction material by the coupling fitting, the locking portion is moved in a direction having a component of the thickness direction with respect the locking target member and is locked with the locking target member, thereby the connecting member connects the two construction materials.

According to this connecting structure, when the coupling portion is coupled to the other construction material of the two construction materials by the coupling fitting, the locking portion is moved in the direction having the component of the thickness direction with respect to the locking target member arranged on one construction material. This locking portion is locked with the locking target member, thereby connecting the two construction materials by the connecting device. For this reason, the two construction materials arranged at a distance therebetween can be connected in the immobile state in the thickness direction perpendicular to the direction of the interval. In addition, this connecting work can be naturally performed by coupling the coupling portion arranged at the connecting member of the connecting device to the other construction material by the coupling fitting. Furthermore, the connecting work can be performed without using fire for welding. Therefore, the connecting work can be easily performed.

According to one embodiment of the connecting structure of the present invention, a plurality of the connecting devices are arranged in the direction perpendicular to the direction of the distance and the thickness direction of the two construction materials, and, when each connecting the two construction materials, the plurality of the connecting devices preferably include a connecting device a direction of inclination of which with respect to the direction of the distance is opposite to that of another one of the connecting devices.

By the plurality of connecting devices whose inclination directions are opposite with respect to the direction of the interval of the two construction materials, the two construction materials can be connected in the immobile state in the direction perpendicular to the direction of the interval of the two construction materials and the thickness direction.

A connecting method for construction materials according to the present invention is a connecting method for construction materials that connects by a connecting device two construction materials arranged at a distance therebetween, the method including a work for arranging the connecting device including a connecting member including a locking portion capable of being locked with a locking target member arranged at one construction material of the two construction materials along a thickness direction perpendicular to a direction of the distance and a coupling portion configured to be moved in the thickness direction and coupled to the other construction material of the two construction materials by a coupling fitting, the locking portion and the coupling portion arranged at an end on a side of the one construction material and an end on a side of the other construction material, respectively, and a work for, by causing thee coupling fitting to move the coupling portion of the connecting member in the thickness direction with respect to the other construction material to couple the coupling portion to the other construction material, moving the locking portion of the connecting member in a direction having a component of the thickness direction with respect to the locking target member to lock with the locking target member and connecting the two construction members by the connecting device.

According to this connecting method, when the coupling portion is coupled to the other construction material of the two construction materials by the coupling fitting, the locking portion is moved in the direction having the component of the thickness direction with respect to the locking target member arranged on one construction material. This locking portion is locked with the locking target member, thereby connecting the two construction materials by the connecting device. For this reason, the two construction materials arranged at a distance therebetween can be connected in the immobile state in the thickness direction perpendicular to the direction of the interval. In addition, this connecting work can be naturally performed by coupling the coupling portion arranged at the connecting member of the connecting device to the other construction material by the coupling fitting. Furthermore, the connecting work can be performed without using fire for welding. Therefore, the connecting work can be easily performed.

According to this connecting method, to perform the work for arranging the connecting device between the two construction materials, the connecting device including the locking portion is preferably attached in advance to one construction material by arranging the locking portion to be movable in the thickness direction with respect to the locking target member.

According to the above operation, the work for arranging the locking portion to be movable in the thickness direction with respect to the locking target member arranged in one construction material after the connecting device is arranged between the two construction materials can be omitted in a narrow space between the two construction materials. For this reason, this work can be performed in the factory or the like where a large work space can be ensured. From this point of view, the connecting work can be easily performed.

Two construction materials to be connected by the connecting device for construction materials, the connecting structure therefor, and the connecting method therefor according to the present invention explained above can be arbitrary construction materials. One example of these construction materials includes a skeleton-side construction material such as a wall, and an opening frame arranged to oppose this construction material in the right-and-left direction. This opening frame can be any of a door frame for a hinged door apparatus, an opening frame for a sliding door apparatus, and an opening frame for a passing opening to be formed in a wall. In addition, the connecting device for construction materials, the connecting structure therefor, and the connecting method therefor according to the present invention can also be used to connect two construction materials such as pillars including a middle pillar of a building, beams, crossbars, and face plates, that is, the present invention is applicable to arbitrary construction materials.

The connecting device for construction materials, the connecting structure therefor, and the connecting method therefor according to the present invention are applicable to construction materials to be newly formed in a structure such as a building, and are also applicable to construction materials to be repaired.

Effect of the Invention

According to the present invention, the two construction materials arranged at a distance therebetween can be connected in the immobile state in the thickness direction perpendicular to the direction of the interval. In addition, this connecting work can be easily performed.

BEST MODE FOR CARRYING OUT THE INVENTION

Figure 1:
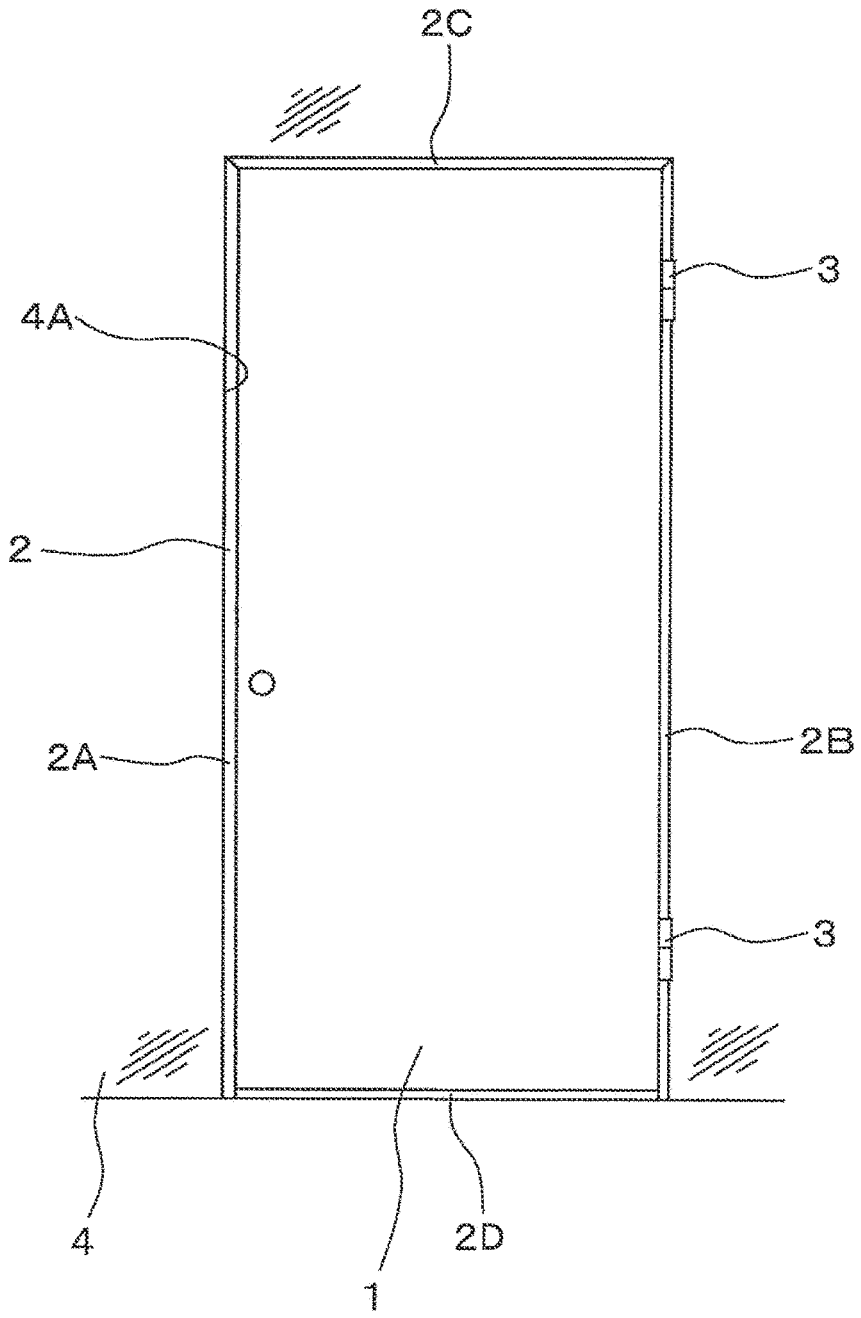
FIG. 1 is a front view showing the overall arrangement of a hinged door apparatus to which a connecting device for construction materials, a connecting structure therefor, and a connecting method therefor according to an embodiment of the present invention are applied.
Figure 2:
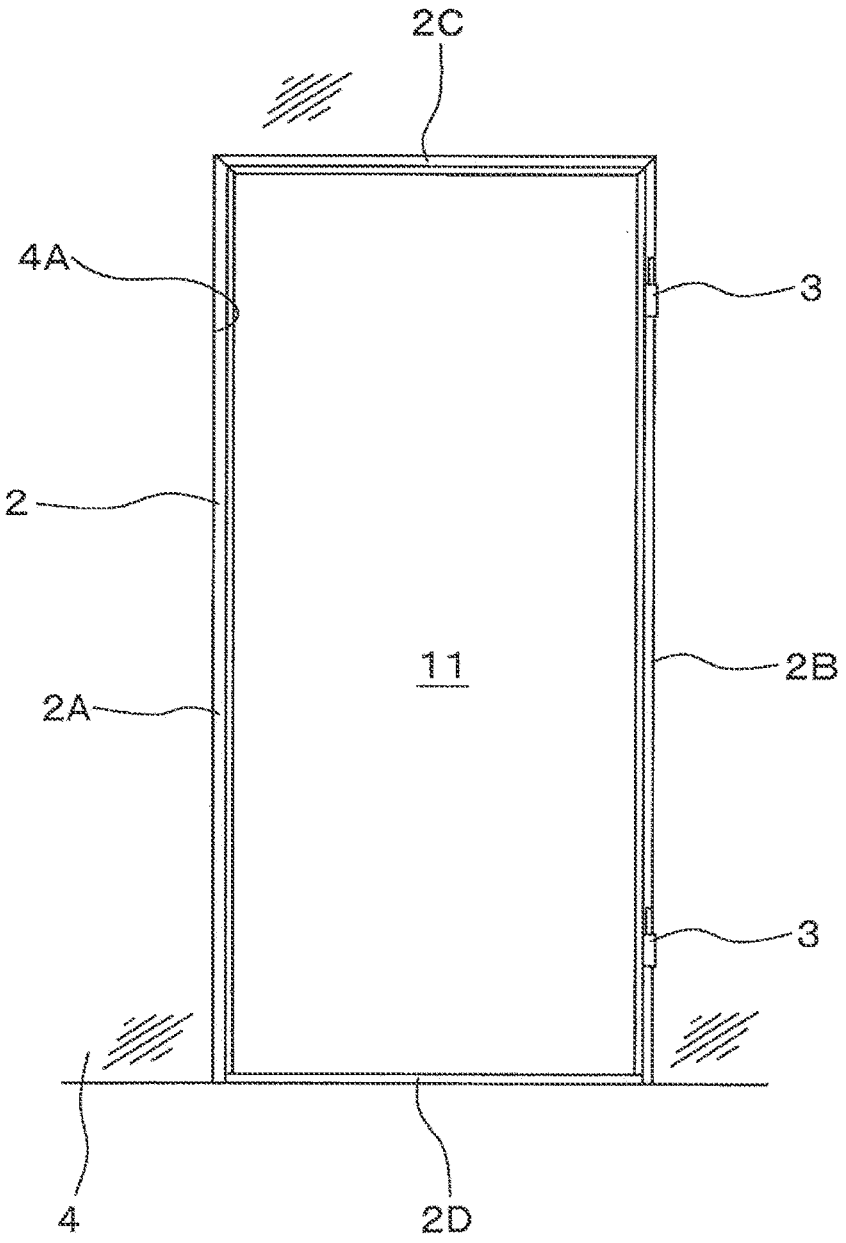
FIG. 2 is a front view showing a door frame serving as a construction material on the side of the hinged door apparatus.

The mode for carrying out the invention will be described with reference to the accompanying drawings. FIG. 1 is a front view showing the overall arrangement of a hinged door apparatus. In this hinged door apparatus, a hinged door 1 is attached to a door frame 2 to be pivotal about hinges 3. The door frame 2 is arranged inside an opening portion 4A formed in a wall 4 serving as a construction skeleton. FIG. 2 shows the door frame 2 before the hinged door 1 is attached. As shown in FIG. 2, the door frame 2 is an opening frame serving as a doorway 11 to open or close the interior by the hinged door 1. In addition, the door frame 2 according to this embodiment is a square frame. For this reason, this door frame 2 includes left and right side frame members 2A and 2B, an upper frame member 2C, and a lower frame member 2D serving as a doorsill. These frame members 2A, 2B, 2C, and 2D are welded and joined in advance in a factory and are transported to a construction site of the structure such as a building.

Note that the door frame 2 may be a three-sided frame in which the lower frame member 2D is absent.

Figure 3:
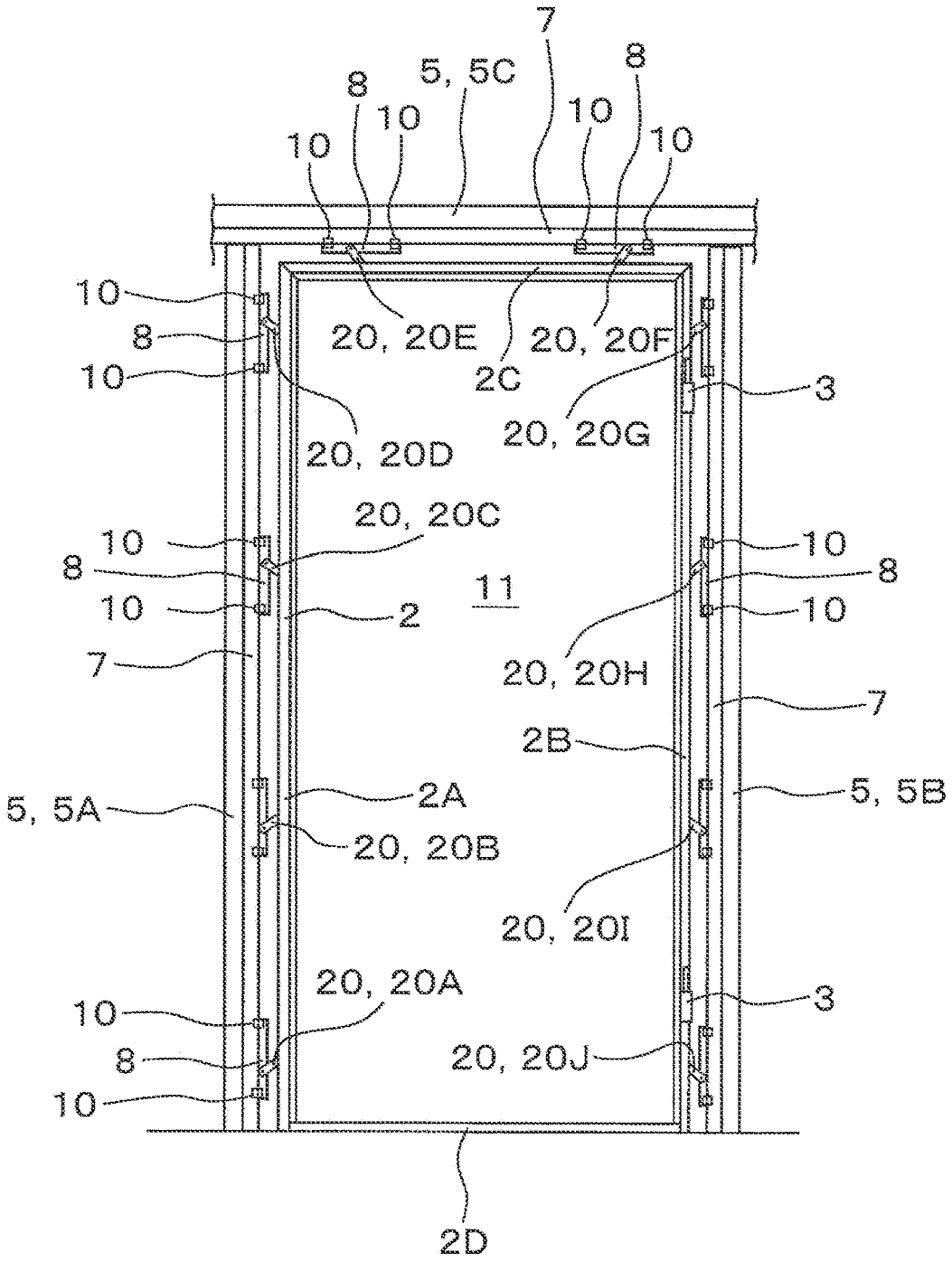
FIG. 3 is a front view showing the overall arrangement showing the connecting structure in which a door frame and an reinforcing member serving as a construction material on the skeleton side are connected by the connecting device.
Figure 4:
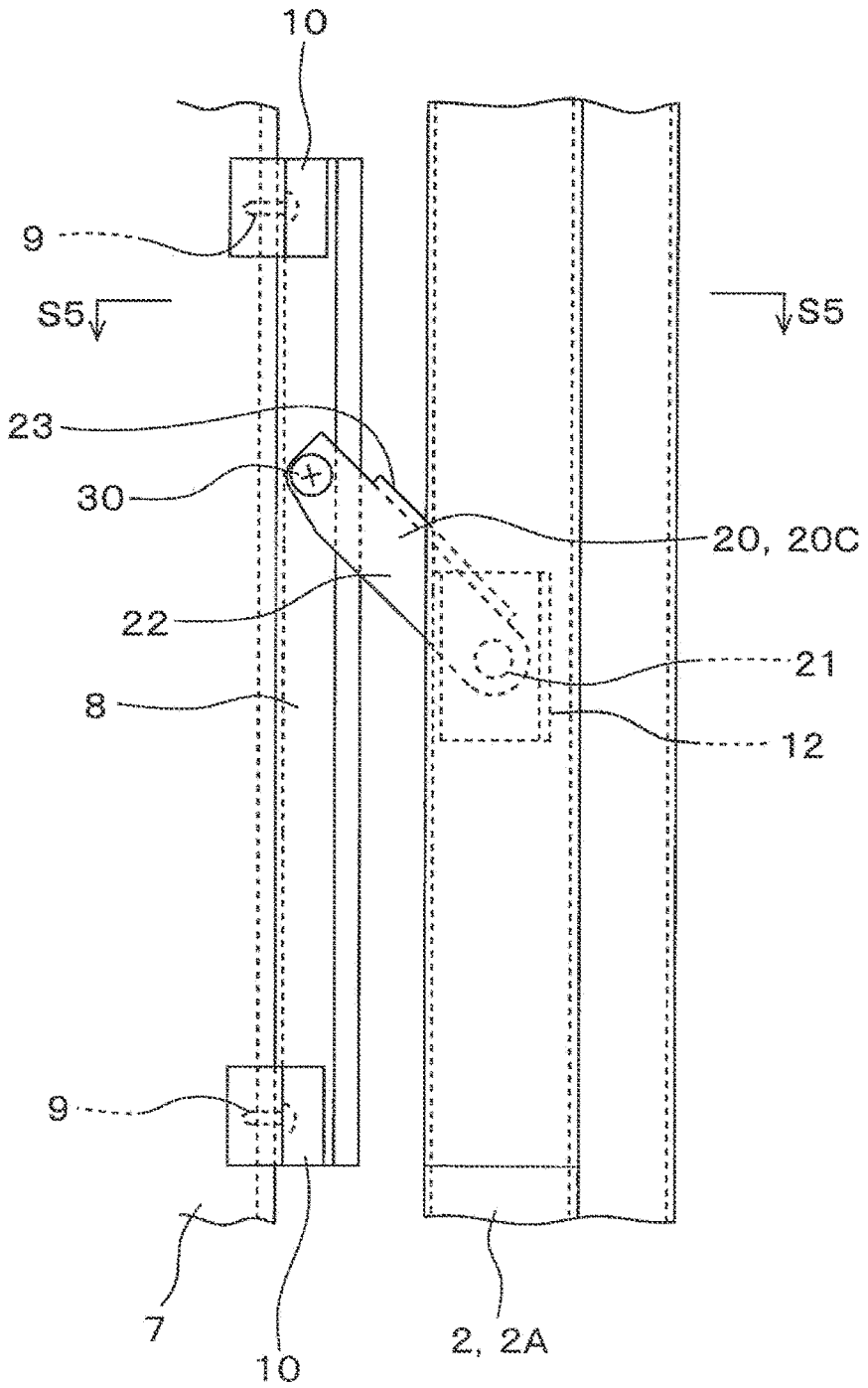
FIG. 4 is a partially enlarged front view of FIG. 3.
Figure 5:
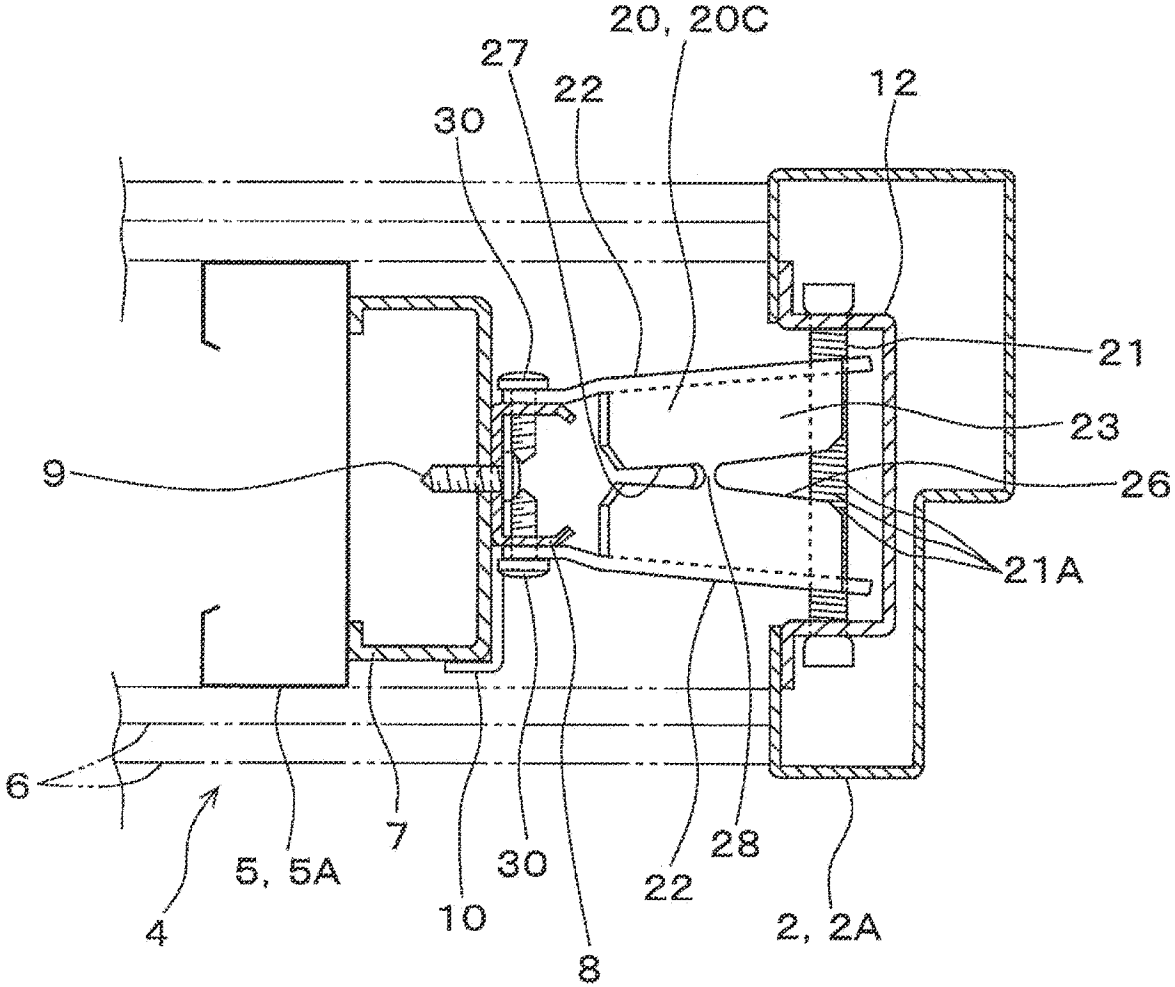
FIG. 5 is a sectional view taken along line S5-S5 in FIG. 4.

FIG. 3 shows the state of arranging the door frame 2 to the wall 4 shown in FIGS. 1 and 2. FIG. 4 is a partially enlarged view of FIG. 3. FIG. 5 is a sectional view along line S5-S5 of FIG. 4. As shown in FIG. 5, the wall 4 shown in FIGS. 1 and 2 is formed by fixing face plates 6 such as gypsum boards to the front and rear surfaces of a core member 5. The door frame 2 is arranged inside the opening portion 4A formed in the wall 4 serving as a construction skeleton and shown in FIGS. 1 and 2. Among a large number of core members 5 arranged inside the wall 4, FIG. 3 shows core members 5A and 5B arranged at positions facing the left and right side frame members 2A and 2B of the door frame 2 in the right-and-left direction such that the longitudinal direction is the lengthwise direction and a core member 5C arranged at a location facing the upper frame member 2C of the door frame 2 in the vertical direction such that the right-and-left direction is the lengthwise direction.

Before the work for arranging the door frame 2 inside the opening portion 4A of the wall 4, reinforcing members 7 shown in FIGS. 3 to 5 are coupled in advance to the core members 5A, 5B, and 5C, respectively. Base members 8 are attached to the reinforcing members 7 by fixing fittings 9 in FIGS. 4 and 5. As for the reinforcing member 7 coupled to each of the core members 5A, 5B, and 5C, the plurality of base members 8 are arranged spaced apart from each other in the lengthwise direction of each reinforcing member 7. In each base member 8, positioning members 10 are coupled to the two end portions of each base member 8 in the lengthwise direction. After these positioning members 10 are brought into contact with one of the two surfaces of the reinforcing member 7 in the thickness direction (the thickness direction of the hinged door 1 and the wall 4) of the door frame 2, the base member 8 is attached to the reinforcing member 7 by the fixing fitting 9. Therefore, each base member 8 is positioned and fixed to the reinforcing member 7 at a predetermined position in the thickness direction of the door frame 7.

In the above description, the core member 5, the reinforcing member 7, and the base member 8 serve as the members on the side of the wall 4 serving as the construction skeleton. For this reason, the core member 5, the reinforcing member 7, and the base member 8 are skeleton-side construction materials. To the contrary, the hinged door 1 and the door frame 2 are members arranged on the side of the hinged door apparatus arranged on the wall 4. For this reason, the hinged door 1 and the door frame 2 serve as hinged door apparatus-side construction materials.

FIG. 3 shows a state in which after a work for arranging the door frame 2 inside the opening portion 4A of the wall 4 is completed, the door frame 2 is connected to the reinforcing members 7 via the base members 8 by connecting devices 20. The plurality of connecting devices 20 are arranged in correspondence with the base members 8 for each of the left and right side frame members 2A and 2B and the upper frame member 2C of the door frame 2. Since the connecting devices 20 have the same shape and the same structure, FIGS. 4 and 5 show, as a representative example, the connecting device 20C arranged on the side frame member 2A of the door frame 2 to connect the side frame member 2A and the reinforcing member 7 coupled to the core member 5A described above, among connecting devices 20A to 20J shown in FIG. 3.

As can be obvious from FIG. 5, the two end portions of a pin-shaped locking target member 21 in the lengthwise direction are fixed and supported by a support member 12 coupled to each of the side frame members 2A and 2B and the upper frame member 2C of the door frame 2. Each of the connecting devices 20A to 20J is attached to the door frame 2 by inserting the corresponding locking target member 21 at the end portion of the corresponding one of the connecting devices 20A to 20J on the door frame 2 side. The connecting devices 20A to 20J are attached to the door frame 2 in advance in the factory. On the other hand, the end portion of each of the connecting devices 20A to 20J on the reinforcing member 7 side is coupled to the base member 8 by drill screws 30 serving as the coupling fittings in the construction installation site of the hinged door apparatus. Accordingly, the door frame 2 serving as the construction material on the side of the hinged door apparatus and the base members 8 and the reinforcing members 7 serving as the skeleton-side construction materials are connected by the connecting devices 20A to 20J.

Note that the lengthwise direction of the pin-shaped locking target member 21 is the thickness direction of the door frame 2 and the wall 4 perpendicular to the right-and-left direction serving as the direction of the interval between the door frame 2, the base member 8, and the reinforcing member 7.

Figure 6A:
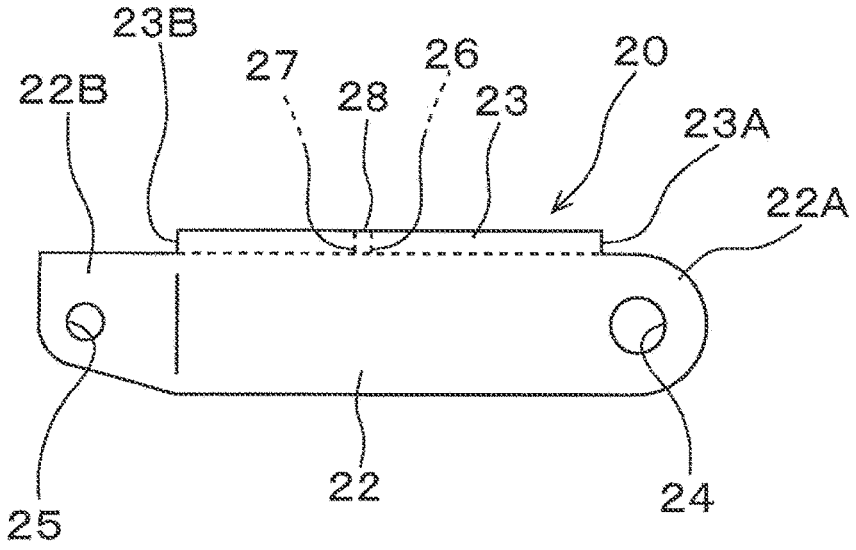
FIG. 6A is a front view showing the connecting device.
Figure 6B:
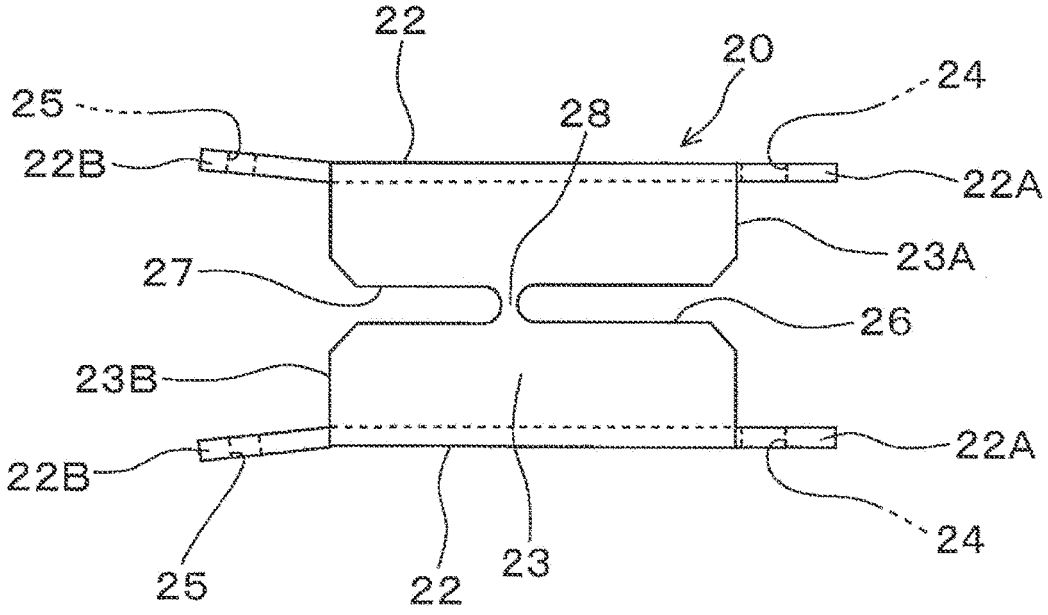
FIG. 6B is a plan view showing the connecting device.

FIGS. 6A and 6B are a front view and a plan view of the connecting device 20. The connecting device 20 includes two connecting members 22 arranged in the thickness direction of the door frame 2 and a bridge portion 23 bridged between these two connecting members 22. The bridge portion 23 is arranged between the connecting members 22 and is connected to one of the upper and lower surfaces of each of the connecting members 22. This connecting device 20 is formed by punching and bending a metal plate. End portions 22A of the connecting members 22 on the door frame 2 side extend from the bridge portion 23 to the door frame 2 side. End portions 22B of the connecting members 22 on the reinforcing member 7 side extend from the bridge portion 23 to the reinforcing member 7 side. Holes 24 are respectively formed in the end portions 22A on the door frame 2 side. These holes 24 serve as insertion portions for receiving the pin-shaped locking target member 21 shown in FIG. 5. In addition, holes 25 are respectively formed in the end portions 22B on the reinforcing member 7 side. These holes 25 serve as coupling portions for coupling the end portions 23B to the base member 8 by the drill screws 30 shown in FIG. 5.

Note that since the diameter of each hole 24 as a round hole is larger than the diameter of the pin-shaped locking target member 21, the locking target member 21 can be inserted in a loosely fitted state in the hole 24.

Two notched portions 26 and 27 notched along the direction of the interval between the door frame 2 and the reinforcing member 7 are formed in the plate-like bridge portion 23. The two notched portions 26 and 27 are formed in the central portion of the bridge portion 23 in the thickness direction of the door frame 2. The notched portion 26 of the notched portions 26 and 27 is notched from an end portion 23A of the bridge portion 23 on the door frame 2 side to the reinforcing member 7 side. The notched portion 27 is notched from an end portion 23B of the bridge portion 23 on the reinforcing member 7 side to the door frame 2 side. A connecting portion 28 in the bridge portion 23 is formed between the notched portions 26 and 27. For this reason, the two connecting members 22 formed in the thickness direction of the door frame 2 are connected by the connecting portion 28 formed in the bridge portion 23.

In the connecting device 20 according to this embodiment, as shown in FIG. 6B, the end portions 22B of the two connecting members 22 on the reinforcing member 7 side extend outward in the thickness direction of the door frame 2 and the wall 4 when the end portions 22B extends from the bridge portion 23 to the reinforcing member 7 side. For this reason, the end portions 22B on the reinforcing member 7 side extend outward from the bridge portion 23 in the thickness direction of the door frame 2 and the wall 4.

Figure 6C:
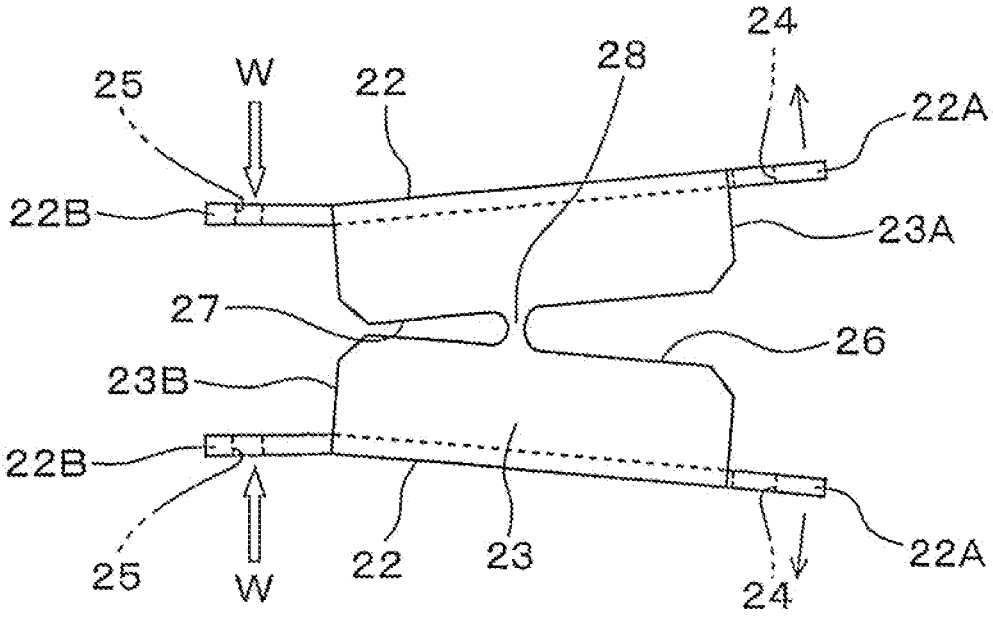
FIG. 6C is a view showing the connecting device and a plan view showing a state in which the connecting device is elastically deformed by notched portions.

In the connecting device 20 having the above structure according to this embodiment, as shown in FIG. 6C, when a load W acts on the end portions 22B of the two connecting members 22 on the reinforcing member 7 side inward in the thickness direction of the door frame 2, and the end portions 22B are moved inward in the thickness direction of the door frame 2 and the wall 4, the notched portion 27 is reduced and at the same time the notched portion 26 is enlarged, thereby causing elastic deformation of the bridge portion 23. The end portions 22A of the two connecting members 22 on the door frame 2 side perform pivot motion for moving and increasing the interval between the end portions 22A in the outward direction in the thickness direction of the door frame 2 and the wall 4, which direction is opposite to the direction of acting the load W about the connecting portion 28.

In addition, the pin-shaped locking target member 21 shown in FIG. 5 is formed by, for example, a bolt shaft whose surface is threaded with a male screw. For this reason, projection/recess portions 21A are formed on the surface of the locking target member 21.

As described above, a work for attaching the connecting devices 20A to 20J to the side frame members 2A and 2B and the upper frame member 2C of the door frame 2 shown in FIG. 3 is performed in the factory. This work is performed by inserting the locking target member 21 shown in FIG. 5 in the holes 24 shown in, for example, FIGS. 6A, 6B, and 6C which are formed in the end portions 22A on the door frame 2 side of the connecting members 22 formed in each of the connecting devices 20A to 20J, and coupling the support member 12 fixed and supported to the two end portions of the locking target member 21 in the lengthwise direction to each of the side frame members 2A and 2B and the upper frame member 2C of the door frame 2 by welding or the like. When this work is performed, the connecting devices 20A to 20J are arranged on the side frame members 2A and 2B and the upper frame member 2C at the locations of the holes 24. In addition, the connecting devices 20A to 20J can be pivotal about the locking target members 21, and the locking target member 21 has a lengthwise direction in the thickness direction of the door frame 2. Accordingly, the connecting devices can be guided by the locking target members 21 and moved in the thickness direction of the door frame 2.

The connecting devices 20A to 20J attached to the door frame 2, as described above, are transported together with the door frame 2 to a construction site such as a building to be constructed where the hinged door apparatus is constructed and arranged. As shown in FIG. 3, the door frame 2 is arranged in a location where the hinged door apparatus is constructed and arranged, that is, a location inside the opening portion 4A of the door 4 shown in FIGS. 1 and 2.

Figure 7:
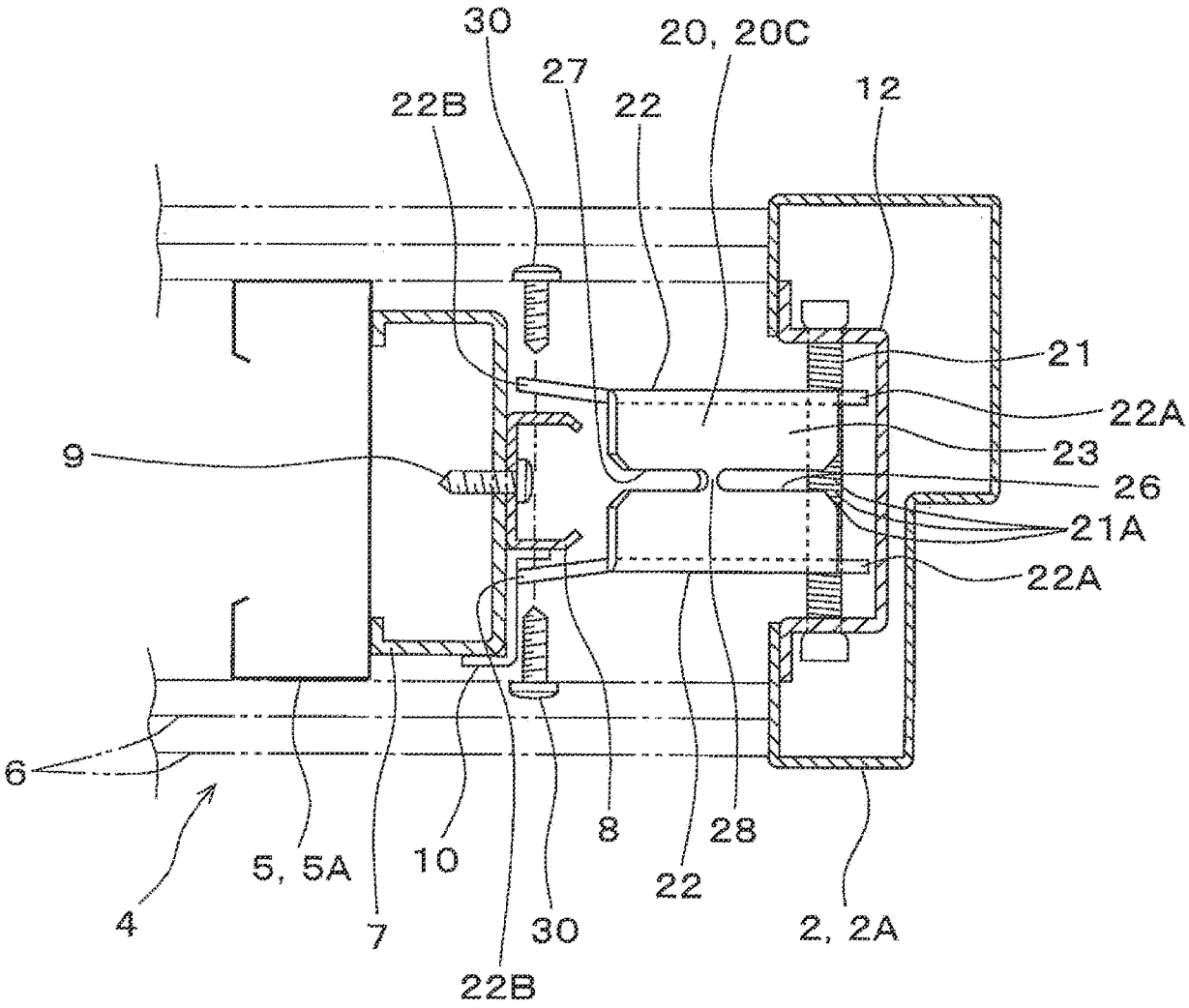
FIG. 7 is a view similar to FIG. 5 when a coupling portion of the connecting device is coupled to a reinforcing member serving as a skeleton-side construction material by a drill screw serving as a coupling fitting.

Next, the worker pivots the locking target member 21 of each of the connecting devices 20A to 20J to insert the base member 8 attached to the reinforcing member 7 between the end portions 22B of the two connecting members 22 on the reinforcing member 7 side which are arranged in each of the connecting devices 20A to 20J. When the base member 8 is inserted between the end portions 22B of the connecting members 22, the tips of the two drill screws 30 shown in FIG. 7 are inserted into, for example, the holes 25 shown in FIGS. 6A, 6B, and 6C formed in the end portions 22B. After the tips of the drill screws 30 are inserted into the holes 25, the drill screws 30 are rotated. Accordingly, the female screw holes threadably engaged with the drill screws 30 are formed by the drill screws 30 themselves, thereby coupling the end portions 22B to the base member 8 by the drill screws 30. Therefore, the door frame 2 serving as the construction material on the side of the hinged door apparatus is connected to the reinforcing members 7 serving as the skeleton-side construction materials to the connecting devices 20A to 20J via the base members 8.

According to this embodiment, in the above work, the holes 24 formed in the end portions 22A of the two connecting members 22 on the door frame 2 side which are arranged in each of the connecting devices 20A to 20J serve as the insertion portions for receiving the locking target member 21. The holes 25 formed in the end portions 22B of the two connecting members 22 on the reinforcing member 7 side, which are arranged in each of the connecting devices 20A to 20J serve as the coupling portions to be coupled to the base member 8 by the drill screws 30. The drill screw 30 serves as a coupling fitting for coupling this coupling portion to the base member 8 serving as a skeleton-side construction material.

The end portions 22B of the two connecting members 22 on the reinforcing member 7 side, which are arranged in each of the connecting devices 20A to 20J extend from the bridge portion 23 and are enlarged outward in the thickness direction of the door frame 2, as shown in FIG. 6B. For this reason, when coupling the end portions 22B to the base member 8 by the drill screws 30, more specifically, the holes 25 formed as the coupling portions in the end portions 22B are moved inward in the thickness direction of the door frame 2 and the wall 4 with respect to the base member 8 until the holes 25 reach the base member 8. After the end portions 22B are brought into contact with the base member 8, the end portions 22B are coupled to the base member 8 by the drill screws 30.

When the end portions 22B of the two connecting members 22 on the reinforcing member 7 side are moved inward in the thickness direction of the door frame 2 and the wall 4 until the end portions 22B are brought into contact with the base member 8, as can be obvious from the explanation of FIG. 6C, the end portions 22A of the two connecting members 22 on the door frame 2 side, which are arranged in each of the connecting devices 20A to 20J perform a pivot motion for moving the end portions 22A to increase a spacing therebetween outward in the thickness direction of the door frame 2 and the wall 4, which direction is opposite to the movement direction of the end portions 22B about the connecting portion 28, upon elastic deformation of the bridge portion 23 in which the notched portions 26 and 27 are formed. Accordingly, by this motion of the end portions 22A, the holes 24 formed in the end portions 22A can be moved with respect to the locking target member 21. Since the movement of the holes 24 with respect to the locking target member 21 is caused by the pivot motion of the holes 24 about the connecting portion 28, the two end portions 22A and the holes 24 formed in the end portions 22A are moved in a direction having an inclination angle with respect to the lengthwise direction of the locking target member 21, that is, the direction having the component of the thickness direction of the door frame 2 and the wall 4, which is the direction of the length of the locking target member 21.

Figure 8:
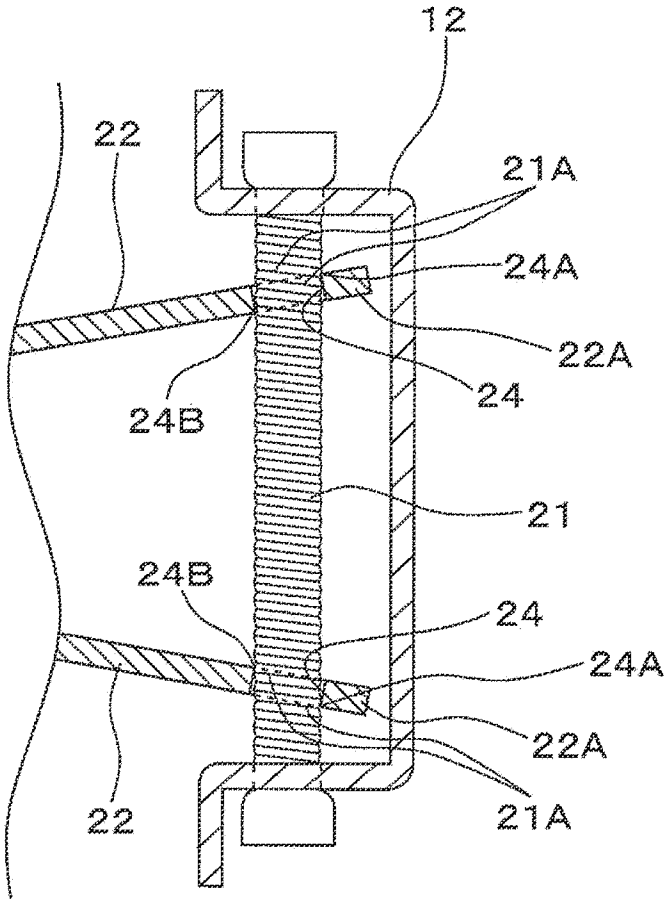
FIG. 8 is a plan sectional view showing a state in which the inner circumferential corner portion of a hole serving as the locking portion of the connecting device and also serving as an insertion portion is locked with the uneven portions on the surface of a locking target member.

FIG. 5 shows the connecting device 20C of the connecting devices 20A to 20J each in which the two end portions 22B are coupled to the base member 8 by the two drill screws 30 as described above. In addition, FIG. 8 is a plan view showing the relationship between the locking target member 21 and the holes 24 formed in the end portions 22A of the two connecting members 22 of each of the fitting fittings 20A to 20J. Since the end portions 22A and the holes 24 are moved in the direction having the inclination angle with respect to the lengthwise direction of the locking target member 21 which is the thickness direction of the door frame 2 and the wall 4, in other words, since the locking target member 21 is obliquely moved, inner circumferential corner portions 24A and 24B of the holes 24 are locked on the surface of the locking target member 21 with an angle. In particular, in this embodiment, since the uneven portions 21A are formed on the surface of the locking target member 21 as described above, the inner circumferential corner portions 24A and 24B of the holes 24 are further reliably locked with the surface of the locking target member 21 by the hooking action of the uneven portions 21A.

For this reason, each hole 24 serves as the insertion portion for receiving the locking target member 21 and at the same time the locking portion of this embodiment arranged in each of the connecting devices 20A to 20J to lock the locking target member 21. After the inner circumferential corner portions 24A and 24B of the holes 24 are locked with the uneven portions 21A on the surface of the locking target member 21, each of the connecting devices 20A to 20J cannot be moved along the locking target member 21 by the locking action of the locking portion for the locking target member 21. For this reason, the door frame 2, the reinforcing member 7, and the base member 8 spaced apart from each other are connected in the direction perpendicular to the direction of the interval between the door frame 2, the reinforcing member 7, and the base member 8 by each of the connecting devices 20A to 20J, that is, connected in the immobile state in the thickness direction of the door frame 2 and the wall 4.

According to this embodiment, after the end portions 22B of the connecting members 22 of each of the connecting devices 20A to 20J on the two reinforcing member 7 side are moved inward in the thickness direction of the door frame 2 and the wall 4 by the drill screws 30, and the end portions 22B are coupled to the base member 8, the two end portions 22A of the connecting members 22 of each of the connecting devices 20A to 20J on the door frame 2 side are naturally moved outward in the thickness direction of the door frame 2 and the wall 4, that is, moved in the direction having the component in the lengthwise direction of the locking target member 21. The inner circumferential corner portions 24A and 24B of the holes 24 formed in the end portions 22A are locked with the locking target member 21. Accordingly, since the door frame 2, the reinforcing member 7, and the base member 8 are connected to each other by each of the connecting devices 20A to 20J, this connecting work can be easily performed without using fire for welding.

In this embodiment, as shown in FIG. 3, the plurality of connecting devices 20A to 20J are arranged between the door frame 2, the reinforcing members 7, and the base members 8. Among the connecting devices 20A to 20J, the connecting devices 20A to 20D and 20G to 20J are vertically arranged in the direction perpendicular to the direction of the interval between the door frame 2, the reinforcing member 7, and the base member 8 and the thickness direction of the door frame 2 and the wall 4. Among the connecting devices 20A to 20D and 20G to 20J, the connecting devices 20A, 20B, 20G, and 20H have an inclination direction opposite to the connecting devices 20C, 20D, 201, and 20J with respect to the right-and-left direction serving as the direction of the interval between the door frame 2, the reinforcing member 7, and the base member 8. Accordingly, the door frame 2 is connected in the immobile sate even for the vertical direction with respect to the reinforcing member 7 and the base member 8 arranged to face the left and right side frame members 2A and 2B of the door frame 2 in the right-and-left direction.

Note that each of the connecting devices 20A, 20B, 20G, and 20H is used to face the bridge portion 23 downward. Each of the connecting devices 20C, 20D, 201, and 20J is used to face the bridge portion 23 upward, as shown in FIG. 4.

In addition, as shown in FIG. 3, the upper frame member 2C of the door frame 2 and the reinforcing member 7 and the base members 8 vertically facing the upper frame member 2C are connected by the connecting devices 20E and 20F. The connecting devices 20E and 20F have opposite inclination directions with respect to the vertical direction as the direction of the interval between the upper frame member 2C, the reinforcing member 7, and the base members 8. For this reason, the door frame 2 is set in the immobile state in the right-and-left direction and connected to the reinforcing member 7 and the base members 8.

The coupling fittings for coupling the end portions 22B of the two connecting members 22 of each of the connecting devices 20A to 20J on the reinforcing member 7 side to the base member 8 are the drill screws 30, as described above. Since the drill screws 30 can form the female screw holes for receiving the drill screws 30 in the base member 8 by the drill screws 30 themselves, after each of the connecting devices 20A to 20J is pivoted to an arbitrary angle about the locking target member 21, the end portions 22B can be coupled to the base member 8 by the drill screws 30. By the pivot angle about the locking target member 21 of each of the connecting devices 20A to 20D and the connecting devices 20G to 20J among the connecting devices 20A to 20J, the position where the door frame 2 is arranged can be adjusted in the right-and-left direction. In addition, by the pivot angle of each of the connecting devices 20E and 20F about the locking target member 21, the position where the door frame 2 is arranged can be adjusted vertically.

In addition, since the positioning members 10 capable of positing the arrangement position of the base member 8 in the thickness direction of the door frame 2 in the reinforcing member 7 are attached to the base member 8 described above, the arrangement position of the door frame 2 can be located at the predetermined position in the thickness direction of the door frame 2.

Figure 9:
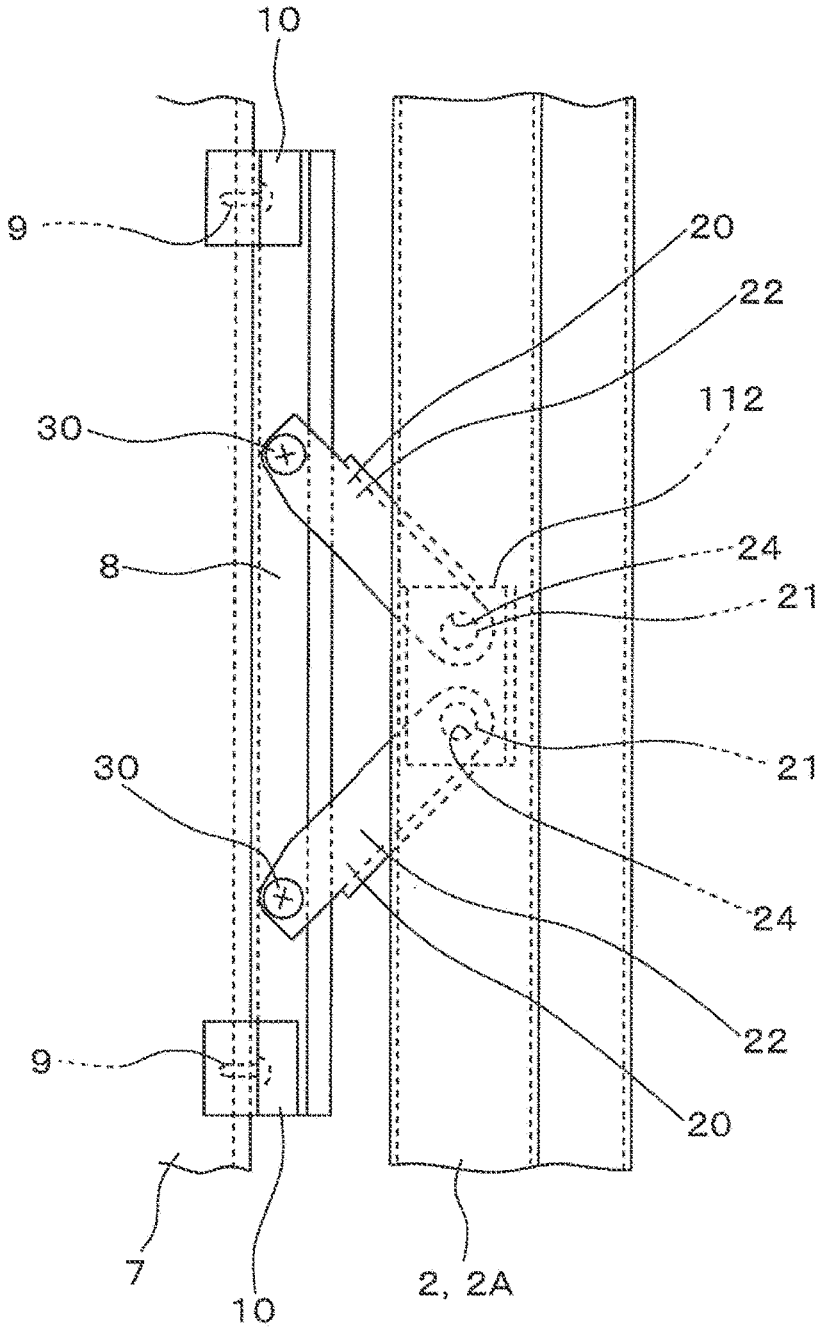
FIG. 9 is a view similar to FIG. 4, which shows another embodiment of the connecting device.

FIG. 9 shows another embodiment of the connecting device. In this embodiment, two end portions of each of two pin-shaped locking target members 21 in the lengthwise direction are fixed and supported by a support member 112 attached to each of side frame members 2A and 2B and an upper frame member 2C (only the side frame member 2A is illustrated in FIG. 9) of a door frame 2. The locking target members 21 are inserted into holes 24 formed in end portions 22A of connecting members 22 of two connecting devices 20 on the door frame 2 side. At the same time, the connecting devices 20 are arranged between the door frame 2, the reinforcing member 7, and the base members 8 such that inclination directions of the connecting devices 20 are opposite to each other with respect to the direction of the interval between the door frame 2, the reinforcing member 7, and the base members 8.

According to this embodiment, the connecting devices 20 arranged such that the inclination directions are opposite to each other in the direction of the interval between the door frame 2, the reinforcing member 7, and the base members 8 are managed as a pair of connecting devices 20, thereby easily handling the connecting devices. Therefore, the management and handling of the connecting devices 20 in the factory or the construction installation site of the hinged door can be facilitated.

In the embodiments described above, the base member 8 has a length shorter than that of the reinforcing member 7. However, the base member may be a long continuous member the length of which is equal to the reinforcing member 7. In addition, the positioning member 10 may be omitted.

INDUSTRIAL APPLICABILITY

For example, the present invention can be used to connect the opening frame to the skeleton-side construction material, for example, when the opening frame such as a door frame serving as an apparatus-side construction material such as a hinged door apparatus or a sliding door apparatus is arranged in the skeleton.

EXPLANATION OF THE REFERENCE NUMERALS AND SIGNS

1 . . . hinged door, 2 . . . door frame as construction material on side of hinged door apparatus, 2A, 2B . . . side frame member of door frame, 2C . . . upper frame member of door frame, 4 . . . wall serving as skeleton, 7 . . . reinforcing member as skeleton-side construction material, 8 . . . base member serving as skeleton-side construction material, 20 . . . connecting device, 20A-20J . . . connecting device, 21 . . . locking target member, 21A . . . uneven portion, 22 . . . connecting member, 23 . . . bridge portion, 24 . . . hole serving as locking portion and also serving as insertion portion, 24A, 24B . . . inner circumferential corner portion, 25 . . . hole serving as coupling portion, 26, 27 . . . notched portion, 30 . . . drill screw serving as coupling fitting.

The invention claimed is:

1. A connecting device for construction materials configured to connect two construction materials arranged at a distance therebetween, the connecting device comprising a connecting member including a locking portion capable of being locked with a locking target member arranged at one construction material of the two construction materials along a thickness direction perpendicular to a direction of the distance and a coupling portion configured to be moved in the thickness direction and coupled to the other construction material of the two construction materials by a coupling fitting, the locking portion and the coupling portion arranged at an end on a side of the one construction material and an end on a side of the other construction material, respectively, wherein in a state in which the coupling portion is not coupled to the other construction material, the locking portion is movable in the thickness direction with respect to the locking target member, and as the coupling portion is moved in the thickness direction and coupled to the other construction material by the coupling fitting, the locking portion is moved in a direction having a component of the thickness direction with respect to the locking target member and is locked with the locking target member, thereby the connecting member connects the two construction materials.

2. The connecting device for construction materials according to claim 1, wherein, when the coupling portion is moved in the thickness direction by the coupling fitting, the locking portion is moved diagonally with respect to the locking target member and locked with the locking target member at an angle.

3. The connecting device for construction materials according to claim 1, wherein a direction in which the locking portion is moved with respect to the locking target member and a direction in which the coupling portion is moved with respect to the other construction material by the coupling fitting are opposite to each other in the thickness direction.

4. The connecting device for construction materials according to claim 3, wherein a plurality of the connecting members are provided in the thickness direction.

5. The connecting device for construction materials according to claim 4, wherein the plurality of connecting members comprise two connecting members, and the connecting device further comprises a bridge portion bridged between the two connecting members.

6. The connecting device for construction materials according to claim 5, wherein the bridge portion is in a form of a plate, and includes a notched portion notched in the bridge portion in a direction of the distance between the two construction materials between the two connecting members.

7. The connecting device for construction materials according to claim 6, wherein the notched portion comprises two notched portions, the two notched portions are notched from two ends of the bridge portion on a side of each of the two construction materials, and a connecting portion for connecting the two connecting members in the bridge portion is formed between the two notched portions.

8. The connecting device for construction materials according to claim 1, wherein the locking target member comprises an elongated member having a length in the thickness direction, and the locking portion is an insertion portion that allows the elongated member to be inserted inside.

9. The connecting device for construction materials according to claim 8, wherein the locking target member includes an uneven portion formed on a surface of the elongated member to engage with an inner circumferential corner portion of the insertion portion.

10. A connecting structure for construction materials configured to connect two construction materials arranged at a distance therebetween by a connecting device disposed between the construction materials, wherein the connecting device comprises a connecting member including a locking portion capable of being locked with a locking target member arranged at one construction material of the two construction materials along a thickness direction perpendicular to a direction of the distance and a coupling portion configured to be moved in the thickness direction and coupled to the other construction material of the two construction materials by a coupling fitting, the locking portion and the coupling portion arranged at an end on a side of the one construction material and an end on a side of the other construction material, respectively, wherein in a state in which the coupling portion is not coupled to the other construction material, the locking portion is movable in the thickness direction with respect to the locking target member, and as the coupling portion is moved in the thickness direction and coupled to the other construction material by the coupling fitting, the locking portion is moved in a direction having a component of the thickness direction with respect to the locking target member and is locked with the locking target member, thereby the connecting member connects the two construction materials.

11. The connecting structure for construction materials according to claim 10, wherein a plurality of the connecting devices are arranged in the direction perpendicular to the direction of the distance and the thickness direction, and, when each connecting the two construction materials, the plurality of the connecting devices include a connecting device a direction of inclination of which with respect to the direction of the distance is opposite to that of another one of the connecting device.

12. A connecting method for construction materials for connecting by a connecting device two construction materials arranged at a distance therebetween, the method including a step of arranging the connecting device including a connecting member including a locking portion capable of being locked with a locking target member arranged at one construction material of the two construction materials along a thickness direction perpendicular to a direction of the distance and a coupling portion configured to be moved in the thickness direction and coupled to the other construction material of the two construction materials by a coupling fitting, the locking portion and the coupling portion arranged at an end on a side of the one construction material and an end on a side of the other construction material, respectively, and a step of moving the locking portion in a direction having a component of the thickness direction with respect to the locking target member to lock with the locking target member, by causing the coupling portion of the connecting member to move by the coupling fitting in the thickness direction with respect to the other construction material and couple the coupling portion to the other construction material, and connecting the two construction materials by the connecting device.

13. The connecting method for construction materials according to claim 12, wherein, in a state in which the coupling portion is not coupled to the other construction material, the locking portion is movable in the thickness direction with respect to the locking target member, and when disposing the connecting device between the two construction materials, the connecting device is attached to the one construction material by arranging the locking portion that is movable in the thickness direction with respect to the locking target member.

* * * * *